US006234615B1

(12) United States Patent
Tsukuda

(10) Patent No.: US 6,234,615 B1
(45) Date of Patent: May 22, 2001

(54) INK INJECTION METHOD, INK INJECTION DEVICE, AND INK-JET RECORDING APPARATUS PROVIDED WITH THE SAME

(75) Inventor: Keiichiro Tsukuda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/340,166

(22) Filed: Jun. 28, 1999

(30) Foreign Application Priority Data

Jun. 30, 1998 (JP) ..... 10-201181
Jun. 15, 1999 (JP) ..... 11-168892

(51) Int. Cl.[7] ..... B41J 2/175
(52) U.S. Cl. ..... 347/85
(58) Field of Search ..... 347/5, 7, 84, 85, 347/86, 87; 141/18, 21

(56) References Cited

U.S. PATENT DOCUMENTS 5,704,403 * 1/1998 Schwenk et al. ..... 141/18
6,022,102 * 2/2000 Ikkatai et al. ..... 347/85

FOREIGN PATENT DOCUMENTS 6-040043 2/1994 (JP) .
7-125232 5/1995 (JP) .
9-234881 9/1997 (JP) .
10-029318 2/1998 (JP) .
10-296991 11/1998 (JP) .

* cited by examiner

*Primary Examiner*—N. Le
*Assistant Examiner*—Anh T. N. Vo
(74) *Attorney, Agent, or Firm*—Fitzpatrick, Cella, Harper & Scinto

(57) ABSTRACT

In a construction in which between ink supply parts and a second chamber of ink tanks is selectively connected through a tube, a needle and septum, ink IN stored in the ink supply parts is supplied to the second chamber of the ink tanks by a pump, and then, a part of ink of the second chamber of the ink tanks is supplied to the ink supply parts, thereby introducing an air from the first chamber to the second chamber through the communicating passage.

12 Claims, 5 Drawing Sheets

INK INJECTION METHOD, INK INJECTION DEVICE, AND INK-JET RECORDING APPARATUS PROVIDED WITH THE SAME

This application is based on Patent Application No. 201181/1998 filed on Jun. 30, 1998 in Japan and No. 168892/1999 filed on Jun. 15, 1999 in Japan, the content of which is incorporated hereinto by reference.

BACKGROUND OF THE INVENTION

1. FIELD OF THE INVENTION

The present invention relates to an ink injection method for injecting an ink into an ink containing chamber of an ink tank, an ink injection device, and an ink-jet recording apparatus provided with the device.

2. RELATED BACKGROUND ART

In a recording head provided in an ink-jet recording apparatus of this kind, since ink is consumed during image formation, it is necessary to supply the recording head with ink normally.

As an ink supply system to the recording head, there is known a method in which an ink tank is provided at a position different from that of a carriage, and the ink tank is connected to the recording head through a tube. In this case, to the recording head, a head difference between the ink tank and the recording head is utilized to supply the ink.

Further, there is a type detachably provided with an ink tank for generating a negative pressure relative to the recording head inside the tank. As a method in one form, there is a method which adopts a head cartridge capable of integrally including the recording head and the ink tank. As an easiest method for generating a negative pressure in the ink tank, a method utilizing a capillary force of a porous body (ink holding body) can be used. There is a proposal about a construction in Japanese Patent Application Laid-open No. 125232/1995 applied by the applicant in which with the aim of solving the problem of porous body of relatively low ink containing efficiency per a unit of volume and to achieve stable ink supply, a porous body is inserted in part of an ink tank.

FIG. 5 shows a schematic sectional diagram of an ink tank utilizing the above-described construction. Inside of an ink tank 101 is partitioned into two spaces by a partition wall 103 having a communicating hole 102. One space is an enclose space except for the communicating hole 102 of the partition wall 103. This space forms an ink containing chamber 104 for keeping the ink, as is, without mixing with other materials. The other space forms an ink holding body containing chamber (atmosphere communicating liquid containing chamber) 106 for containing an ink holding body 105. On the wall surface forming the ink holding body containing chamber 106, there are formed an atmosphere communicating port 107 for introducing the air in association with an ink consumption, and a supply port 108 for supplying ink to the recording head part. In such a tank structure, when ink in the ink holding body 105 is consumed by the recording head, the air is introduced from the atmosphere communicating port 107 to the ink holding body containing chamber 106, and the air is introduced through the communicating hole 102 of the partition wall 103 into the ink containing chamber 104. In replacement with this, ink from the ink containing chamber 104 is charged to the ink holding body 105 of the ink holding body containing chamber 106 through the communicating hole 102 of the partition wall 103. Therefore, even when ink is consumed by the recording head, ink is charged to the ink holding body 105 according to the consumption amount.

Since the ink holding body 105 holds a constant amount of ink, and maintains a constant negative pressure to the recording head (this state being called "gas-liquid replacement state"), an ink supply to the recording head is stabilized. In particular, as in the description of Japanese Patent Application Laid-open No. 40043/1994, by forming a passage for introducing the atmosphere in the vicinity of the communicating part between the ink holding body containing chamber and the ink containing chamber, ever-better supply of ink to the recording head can be achieved.

In the above-described types, in either type of the head pressure utilization or negative pressure utilization, the ink tank is generally replaced with new one when the ink is exhausted.

On the other hand, in view of liquid replenishment when equipped on an apparatus of a relatively large recording amount, in such an apparatus, a large capacity tank for holding ink (hereinafter referred to as "a large tank") is provided, and a head cartridge integrally having an ink tank and a recording head is mounted on the carriage. The carriage is moved to a predetermined position, the ink tank (hereinafter referred to as "a tank part") of the head cartridge is connected to the large tank, thereby replenishing ink to the tank part. This is known as an ink supply system of a type called as a so-called pit-in.-system.

In Japanese Patent Application Laid-open No. 234881/1997 applied by the applicant, while using such a pit-in system, there is a proposal about an ink supply system and a recording apparatus with improved throughput without causing unnecessary consumption of ink with a simple construction by utilizing the ink tank shown in FIG. 5 as the "tank part".

Further, in Japanese Patent Application Laid-open No. 29318/1998 applied by the applicant, there is a proposal about an ink supply system and a recording apparatus capable of making liquid replenishment in shorter time and smoothly. Any of these inventions eliminate the need for a pump for replenishing liquid, is thus simple in construction, and is capable of constructing a compact apparatus, thus providing a superior liquid supply system.

However, for example, in the case of recording to a relatively large-sized recording medium (e.g. A0 size poster or the like), that is, requirement for down-sizing of the recording apparatus is not so high, there may be causes where generation of stable negative pressure by the tank part to the head during recording and improved ink replenishment speed may be required, rather than simplification of the apparatus construction.

SUMMARY OF THE INVENTION

In consideration of the above prior art problems, a first object of the present invention is to provide, in an ink injection method, an ink injection device, and an ink-jet recording apparatus provided with the same, an ink injection method capable of setting pressure in the ink tank at a predetermined negative pressure, an ink injection device, and an ink-jet recording apparatus provided with the same.

Another object of the present invention is to provide various inventions occurred when attaining the above first object.

A concrete objects of the present invention will be apparent from the following construction.

In accordance with the present invention which attains the above object, there is provided an ink injection method for replenishing ink using a replenishing vessel to an ink tank having a first chamber for containing a negative pressure generating member and provided with an atmosphere communicating port for communicating with outside and an ink supply port for supplying an ink to the outside and a second chamber communicating with the first chamber through the communicating portion and forming a substantially enclose space except for the communicating portion, comprising the step of conducting the second chamber and the replenishing vessel by a first passage for communicating gas in the second chamber with gas in the replenishing vessel and a second passage, which is different from the first passage, for moving ink in the replenishing vessel to the second chamber with forming a substantially enclose space relative to an atmosphere except for the communicating portion by the second chamber and the replenishing vessel, after the step of the conducting, an ink injecting for moving an ink in the replenishing vessel to the second chamber through the second passage, and moving an air in the second chamber to the replenishing vessel through the first passage; and after the step of the ink injecting, a gas introducing for discharging an ink from the second chamber to the replenishing vessel and introducing the atmosphere through the communicating part and through the atmosphere communicating port of the first chamber into the second chamber.

Further, an ink injection device according to the present invention, having an ink tank for holding ink, and a replenishing vessel for holding ink for supplying the ink tank to replenish an ink from the replenish vessel to the ink tank in which the ink tank contains a negative pressure generating member, the ink tank including a first chamber provided with a supply port for supplying ink to the outside and an atmosphere communicating port, and a second chamber for forming a substantially enclose space except for the communicating portion communicating with the first chamber, wherein the second chamber and the replenishing vessel are communicated with each other by a first passage for communicating gas in the second chamber with gas in the replenishing vessel and by a second passage, which is different from the first passage, for moving liquid in the replenishing vessel to the second chamber, and the second passage is provided with a pump capable of promoting an ink movement both from the replenishing vessel to the second chamber and from the second chamber to the replenishing vessel.

Still further, an ink-jet recording apparatus according to the present invention has an ink tank for holding an ink, a recording head for ejecting an ink supplied from the ink tank to make recording on the recording medium, and an ink replenishing vessel for holding ink for replenishing the ink tank comprising, the ink tank containing a negative pressure generating member the ink tank including a first chamber a supply port for supplying an ink to the recording head and an atmosphere communicating port, a second chamber having a communicating portion for communicating with the first chamber and forming a substantially enclose space except for the communicating portion, the second chamber and the replenishing vessel are communicated with each other by a first passage for communicating gas in the second chamber with gas in the replenishing vessel and by a second passage, which is different from the first passage for moving ink in the replenishing vessel to the second chamber, and the second passage is provided with a pump capable of promoting ink movement both from the replenishing vessel to the second chamber and from the second chamber to the replenishing vessel.

According to the above-described ink injection method, ink injection device, and the ink-jet recording apparatus, since the ink tank after ink injection is possible to make extraction of ink in a so-called gas-liquid replacement state when introducing ink out to the outside, an ink tank with a stabler negative pressure in the extraction portion (recording head in the case of ink-jet recording apparatus) can be provided. For this reason, there is not a fear of occurrence of ink leakage from the extraction portion of the first chamber due to the fact that the second chamber is higher in pressure than the first chamber.

Further, by using a combination of the pump in the supply operation and the evacuation operation, time for liquid supply can be shortened as compared with a case of performing liquid supply simply utilizing a potential energy. Still further, by providing ink remaining amount detecting means, the ink injection method of the present invention can be easily used in a pit-in type of apparatus and the like.

Yet further, another ink-jet recording apparatus of the present invention is developed on the basis of the above ink injection method and having an ink tank for holding an ink, a recording head for ejecting the ink supplied from the ink tank to make recording on a recording medium, and an ink replenishing vessel for holding ink for replenishing the ink tank comprising, a first passage connectable to the ink tank for communicating the ink tank with the replenishing vessel, a second passage provided with ink moving means connectable to the ink tank for communicating the ink tank and the replenishing vessel with each other and capable of making ink movement in both directions, in which a connection portion to the ink tank is provided beneath the connection portion of the ink tank of the first passage, control means for controlling connection of the first and the second passages and operation of the ink moving means, wherein the control means controls an ink injection step in which at least the first and second passages and the ink tank are connected by the function of the control means for injecting the ink from the second passage to the ink tank and, according to the ink injection, an air in the ink tank is discharged through the first passage, and a discharging step in which the first passage is in a disconnected state, for discharging ink injected through the second passage by the ink moving means from the ink tank so that a negative pressure in the ink tank is at a predetermined value.

With the above ink-jet recording apparatus, by providing the ink discharging means, the inside of the ink tank can be maintained at a desired negative pressure, and by using a pump for ink injection and discharging, ink supply time be reduced.

The above and other objects, effects, features and advantages of the present invention will become more apparent from the following description of embodiments thereof taken in conjunction with the accompanying drawings.

DETAILED DESCRIPTION OF THE PREFERRED EMBODIMENTS

Next, embodiments of the present invention will be described with reference to the drawings.

Figure 2:
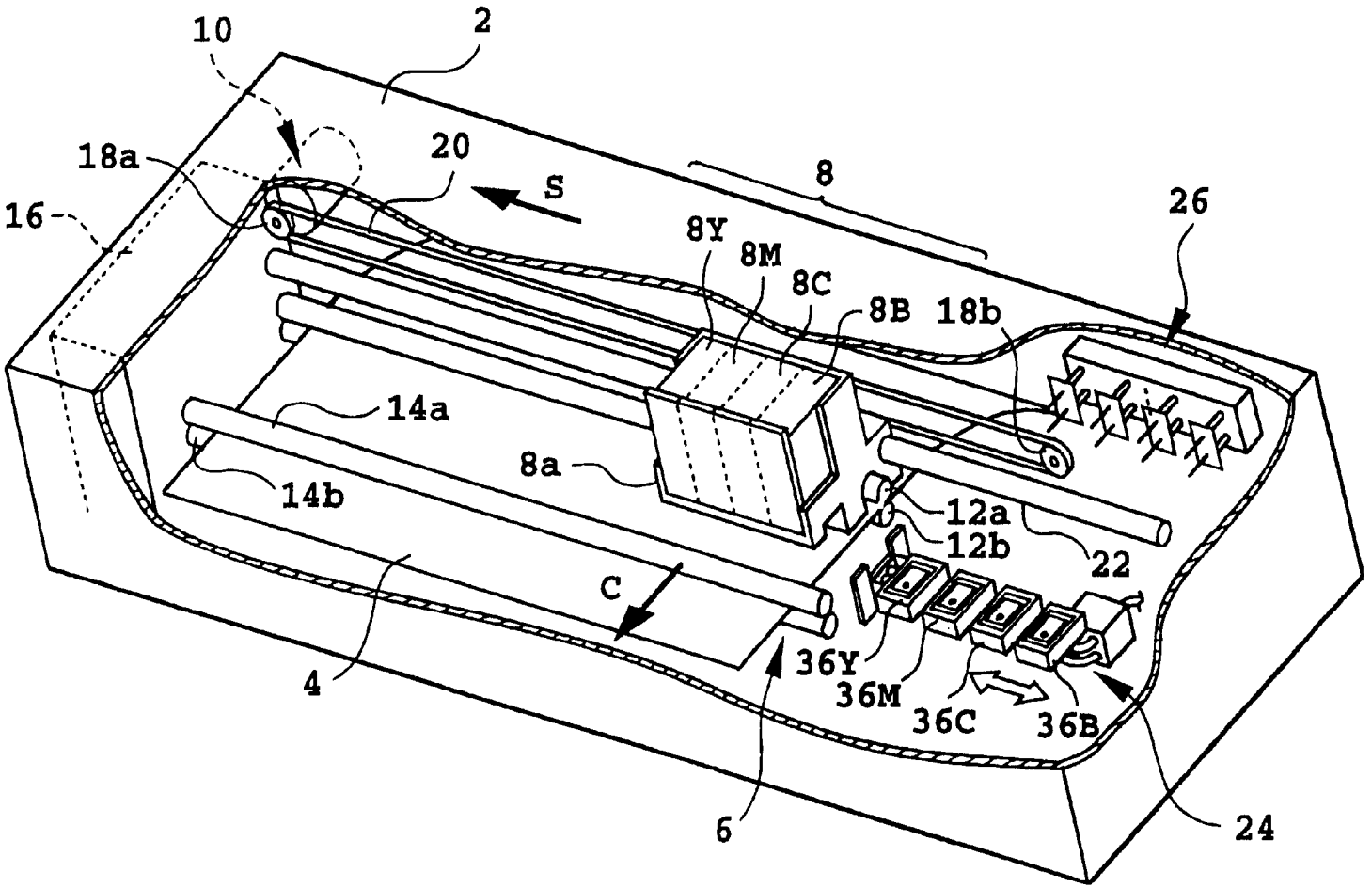
FIG. 2 is a schematic perspective diagram showing an example of an ink-jet recording apparatus provided with the ink injection device according to the present invention.

FIG. 2 shows a schematic construction of an example of ink-jet recording apparatus provided with the ink injection device according to the present invention. In FIG. 2, the ink-jet recording apparatus includes in a casing 2 a transportation device 6 for intermittently transporting a paper 4 as a recording medium disposed in the longitudinal direction, in a direction indicated by arrow C shown in FIG. 2, a recording portion 8 reciprocally moved in nearly parallel to a direction nearly perpendicular to the transportation direction of the paper 4 by the transportation device 6, and a carriage drive portion for reciprocally moving a carriage member 8*a* along with the recording portion 8.

The transportation device 6 comprises a pair of roller units 12*a* and 12*b*, a pair of roller units 14*a* and 14*b*, opposingly disposed nearly in parallel to each other, and a drive part 16 for driving these roller units 12*a* and 12*b*, roller units 14*a* and 14*b*. Therefore, when the drive part 16 is in operation, the paper 4 is nipped between the respective roller units 12*a* and 12*b* and roller units 14*a* and 14*b* and intermittently transported in a direction of arrow C shown in FIG. 2.

The carriage drive portion 10 comprises a belt 20 wrapped around pulleys 18*a* and 18*b* disposed on rotary shafts disposed in opposition with a predetermined spacing, a guide shaft 22 disposed nearly parallel to the roller units 12*a* and 12*b* for guiding movement of the carriage member 8*a* of the recording portion 8, and a motor 10*m* for driving the belt 20 connected to the carriage member 8*a* in the recording portion 8 in a forward direction and reverse direction.

When the motor 10*m* is in operation and the belt 20 along with the pulley 18*a* connected to the motor 10*m* is rotated in a direction of arrow S in FIG. 2, the carriage member 8*a* of the recording portion 8 is moved by a predetermined amount in the same direction. Further, when the motor 10 m is in operation and the belt 20 is rotated in a direction reverse to that shown arrow S in FIG. 4, the carriage member 8*a* of the recording portion 8 is moved by a predetermined moving amount in a direction reverse to that shown by arrow S in FIG. 4.

The recording portion 8 is provided with ink tanks 8Y, 8M, 8C, and 8B for inks of respective colors, for example, yellow, magenta, cyan, and black. Further, each of the respective ink tanks 8Y to 8B has an ink-jet head 28. Each ink-jet head 28 has a plurality of ink ejection port formed with predetermined mutual intervals along the transportation direction of the paper 4. Each ink-jet head 28 is provided in its ink ejection portion with a known structure having an electrothermal converter for heating the ink to eject.

The ink tanks 8Y to 8B for supplying the respective ink-jet heads 28 with respective color inks are detachably provided to the carriage member 8*a* of the recording portion 8. Since the respective ink tanks 8Y to 8B have the same structure as shown in respective embodiments, only the ink tank 8B is described, and description of other ink tanks is omitted.

(First Embodiment)

Figure 1:
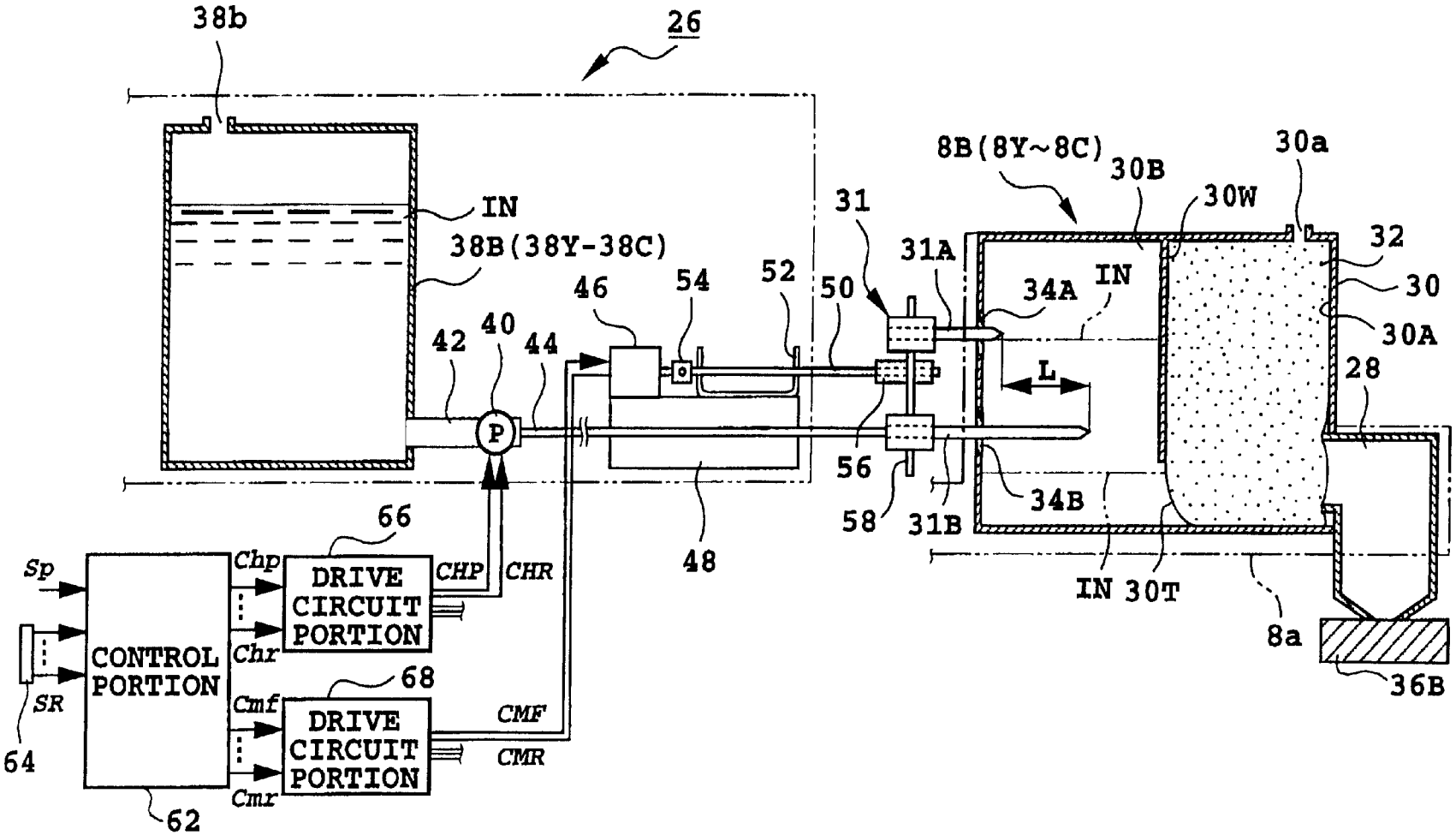
FIG. 1 is a schematic diagram showing the structure of a first embodiment of the ink injection device together with the ink tank according to the present invention.

FIG. 1 is a diagram for explaining an ink supply passage in a first embodiment of an ink injection device according to the present invention. The inside of a case 30 of an ink tank 8B molded from a resin material is divided by a partition wall 30W into a first chamber 30A for containing an ink absorber 32 and a second chamber 30B for storing a predetermined amount of ink IN, and the first chamber 30A and the second chamber 30B are communicated with each other by a communicating passage 30T.

The ink absorber 32 of the first chamber 30A is made of, for example, a porous material such as urethane foam. In the upper part of the first chamber 30A, a communicating hole 30*a* is provided for communicating the outer atmosphere with the inside of the first chamber 30A. Further, the first chamber 30A is connected with the other end of the ink-jet head 28.

Therefore, ink contained in the ink absorber 32 is successively supplied to the ink ejection portion according to the ink ejecting operation of the ink-jet head 28.

The ink IN stored in the second chamber 30B is filled in a predetermined amount in the second chamber 30B in an initial state, for example, so that the liquid surface is formed at a position indicated by the chain double-dashed line in FIG. 1. Further, on the wall surface of the second chamber 30B opposing the partition wall 30W, septum 34A and 34B pierced by tips of respective needles 31A and 31B of an ink injection device which will be described later, are provided at a predetermined mutual spacing. The septum 34A and 34B are made of, for example, a rubber material which, when pierced by tips of the needles 31A and 31B, seals the outer periphery of the needles 31A and 31B. Still further, when tips of the needles 31A and 31B is pulled out, the septum 34A and 34B automatically close the holes formed by the tips of the needles 31A and 31B.

It is a matter of course that connection of the second chamber 30B with tubes (needles 31A and 31B) which will be described later is not limited to utilization of the septum 34A and 34B, but tubes and the second chamber 30B may be connected through a self-sealing type connector.

Further, at one end sides of the roller units 12a and 12B, as shown in FIG. 2, at a position to be a home position of the carriage member 8*a*, a recovery unit 24 for performing ejection recovery operation of the recording portion 8 is provided in opposition to ink ejection port array of the recording portion 8. The recovery unit 24 has respective capping members 36Y, 36M, 36C, and 36B corresponding to the respective ink jet heads 28.

The respective capping members 36Y to 36B, by a hoisting and lowering mechanism (not shown), take a position close to and seal the ink ejection port formation surface of each ink-jet head 28, or a position away from the ink ejection port formation surface. Further, when the respective capping members 36Y to 36B are in a position close to the ink ejection port formation surface of the respective ink-jet heads 28 and the respective ink-jet heads 28 perform preliminary ejection of ink as ejection recovery operation, ejected respective ink is supplied to a waste liquid tank (not shown) through the respective capping members 36Y to 36B. Still further, in opposition to the recovery unit 24, an ink injection device 26 is provided across a guide shaft 22.

The ink injection device 26, as shown in FIG. 1, comprises ink supply parts 38Y to 38B storing respective color inks supplied corresponding to the respective ink tanks 8Y to 8B, and injection mechanism portions 31 provided for the respective ink supply parts 38Y to 38B. Since the respective ink supply parts 38Y to 38B and the respective injection mechanism portions 31 are same in structure, only the ink supply part 38B and the injection mechanism portion 31 provided for the ink tank 8B will be described, and description of ink supply parts and injection mechanism portions provided corresponding to other ink tanks is omitted. A predetermined amount of black ink IN is stored in the ink supply part 38B. At the upper part of the ink supply part 38B, an atmosphere communicating port 38B is provided for communicating the inside space with the outer atmosphere. Further, in an extraction/introduction passage 42 of the ink supply part 38B, a pump 40 is provided for supplying the ink IN to the ink tank 8B side and returning a predetermined amount of the ink IN stored in the second chamber 30B of the ink tank 8B to the inside of the ink supply part 38B. The pump 40 is, for example, a liquid feed pump in which the outer periphery of a tube is squeezed by revolution of a plurality of rollers around a rotary shaft to feed the ink. The rotary shaft is connected to an output shaft of a drive motor. Therefore, by rotating the output shaft of the motor in the forward direction or the reverse direction, the plurality of rollers while rotating are revolved in the forward direction or the reverse direction around the rotary shaft. The motor is driven and controlled according to a control signal from a control portion 62 which will be described later.

The introduction/extraction passage 42 is connected with an end of a tube 44 made of a flexible material. The other end of the tube 44 is connected to the needle 31B having at the tip thereof a hole communicating with the inside of the tube 44.

The needle 31B is connected together with the needle 31A by a support member 58. The needle 31A and the needle 31B are parallel to each other and are supported to be nearly perpendicular to the surface of the septum 34A and 34B of the wall surface at the back surface side of the ink tank 8B. Length of the needle 31B is longer than the length of the needle 31A by a predetermined size L. The needle 31A has at its tip a through hole communicating with the atmosphere through its inside.

In a connection member 56 provided between the needle 31A and the needle 31B in the support member 58, a female thread part thereof is engaged with one end of a ball screw shaft 50.

The ball screw shaft 50 is rotatably supported on a bearing member 52 provided on an upper surface of a base table 48. The other end side of the ball screw shaft 50 is connected to the output shaft of a motor 46 through a joint member 54. The motor 46 is, for example, a stepping motor, which is driven and controlled by a control signal from the control portion 62 which will be described later.

When the motor 46 is in operation and its output shaft is rotated in the forward direction, the support member 58 along with the needles 31A and 31B is moved in a direction to approach the ink tank 8B. Further, when its output shaft is rotated in the reverse direction, the support member 58 along with the needles 31A and 31B is moved away from the ink tank 8B. Therefore, when the support member 58 along with the needles 31A and 31B is moved in a direction to approach the ink tank 8B by a predetermined distance, the needles 31A and 31B are respectively pierced to the surface of the septum 34A and 34B.

In addition, the ink injection device 26, as shown in FIG. 1, is provided with the control portion 62 for performing operation control of the pump 40 and the motor 46.

The control portion 62 is supplied with a detection signal Sp representing that the carriage member 8*a* mounting the ink tanks 8B to 8Y reaches a predetermined home position, and respective detection output signal group SR from an ink remaining amount detection part 64 for detecting that ink remaining amount of each of the ink tanks 8B to 8Y is less than a predetermined value. The ink remaining amount detection part 64 is, for example, a liquid surface sensor provided in each of ink tanks 8B to 8Y for optically detecting ink remaining amount. The ink remaining amount may be detected by calculation from an initial value of ink remaining amount and the number of ejecting dot counts of ink amount per a predetermined unit of the recording portion 8.

The control portion 62 first forms a control signal group Cmf so that tips of the needles 31A and 31B of the injection mechanism portion 31 corresponding to the respective ink tanks 8B to 8Y required to be supplied with ink according to the detection signal Sp and detection output signal group SR are pierced to the septum 34A and 34B, and supplies these signals to a drive circuit portion 68, The drive circuit portion 68 forms a drive control pulse signal group CMF on the basis of the control signal group Cmf, and supplies the resulting signal group to the motor 46. This moves each support member 58 towards each of ink tanks 8B to 8Y forward by a predetermined distance, so that the tips of the needles 31A and 31B, as shown in FIG. 1, pierce into the septum 34A and 34B to be reached the inside of the second chamber 30B. At this moment, the capping members 36B to 36Y are moved upward to cover the ink ejection port formation surface of the ink-jet head 28.

Next, the control portion 62 forms a control signal group Chp for replenishing a predetermined amount of each ink to each of ink tanks 8B to BY, and supplies these signals to a drive circuit portion 66. The drive circuit portion 66 forms a drive control pulse signal group CHP on the basis of the control signal group Chp, and supplies these signals to the respective pumps 40.

The ink supply amount is preferably set so that in view of shortening the injection operation time ink leakage does not occur from the capping member 36 and the supply amount per unit time is relatively large.

Figure 3A:
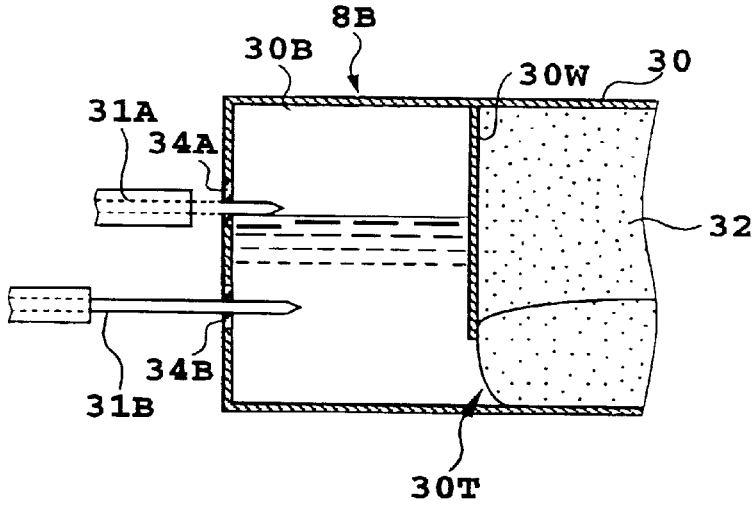
FIGS. 3A to 3C are diagrams for explaining operation of the example shown in FIG. 1.

This supplies a predetermined amount of the ink IN through the tube 44 and the needle 31B to the second chamber 30B, and the liquid surface is raised from the position in the vicinity of the communicating passage 30T to the position shown in FIG. 3A. At this moment, in the second chamber 30B, air in the space above the ink IN is discharged through the hole of the needle 31A. In this case, depending on the liquid supply capacity of the pump 40 (for example, liquid supply is considerably faster than air discharge.), part of supplied liquid may move to the first chamber 30A through the communicating passage 30T. Even in this case, since the ink ejection port formation surface of the ink-jet head 28 is covered with the capping member 36B, ink will never leak from the head.

Figure 3B:
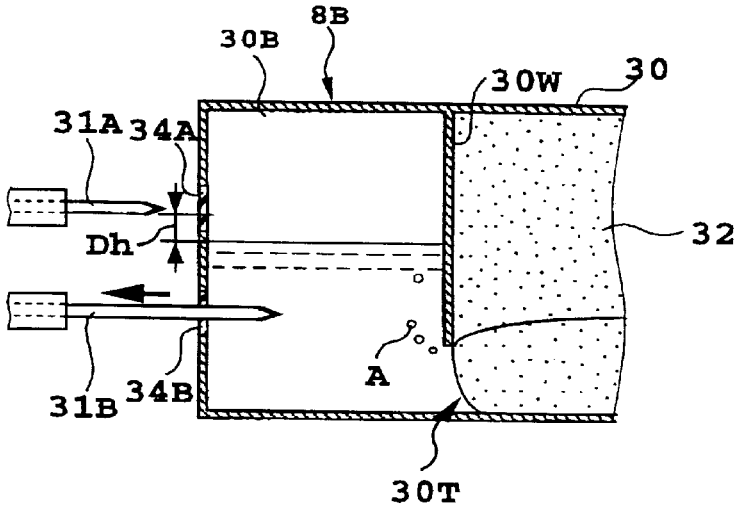

Next, the control portion 62 forms a control signal group Cmr so as to retreat the tips of the needles 31A and 31B from the respective positions shown in FIG. 3A to the positions shown in FIG. 3B, and supplies these signals to the drive circuit portion 68. The drive circuit portion 68 forms a drive control pulse signal group CMR on the basis of the control signal group Cmr, and supplies the resulting signal group to the motor 46. This pulls out the tip of the needle 31A from the septum 34A. Next, the control portion 62 forms a control signal group Chr so as to return a predetermined amount of each ink from the respective ink tanks 8B to 8Y to the respective ink supply parts 38B to 38Y so that the inside pressure of the ink tanks 8B to 8Y is set to a predetermined negative pressure, and supplies these signals to the drive circuit portion 66. The drive circuit portion 66 forms a drive pulse control signal group CHR on the basis of the control signal group Chr, and supplies the resulting signal group to the respective pumps 40.

This returns a predetermined amount of the ink IN to the ink supply part 38B so that liquid surface of the ink IN, for example, of the second chamber 30B of the ink tank 8B is moved down by Δh from the position shown in FIG. 3A to the position shown in FIG. 3B. At this moment, a part of air introduced through the atmosphere communicating port 30a becomes an air bubble A and taken in the second chamber 30B through the communicating passage 30T. Further, if the ink amount held in the ink absorber 32 contained in the first chamber 30A is larger than the ink holding amount of the ink absorber in the gas-liquid replacement state, the ink of the excess amount is extracted through the communicating passage 30T from the needle 31B to the outside. Consequently, at this moment, interface between gas and liquid of the ink absorber is the same as the interface at the time of gas-liquid replacement state when the tank part alone operates as an ink tank.

Figure 3C:
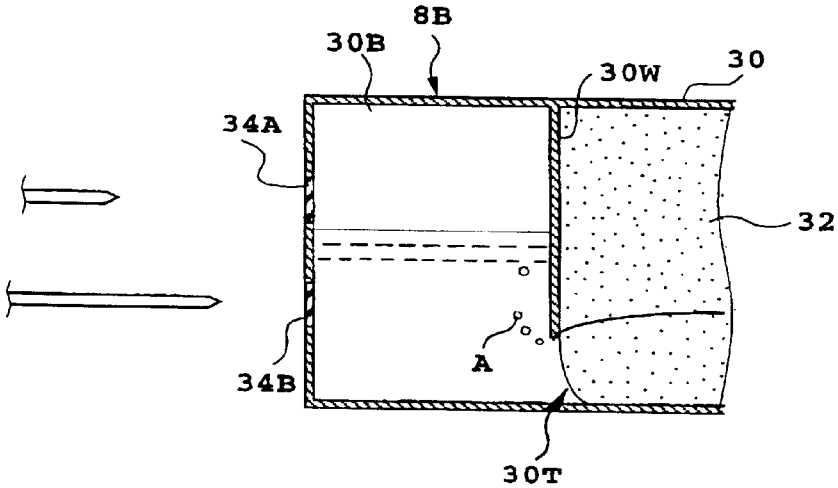

The control portion 62 forms a control signal group Cmr to retreat the tips of the needles 31A and 31B further to the initial position shown in FIG. 3C, and supplies these signals to the drive circuit portion 68. The drive circuit portion 68 forms a drive control pulse signal group CMR on the basis of the control signal group Cmr, and supplies the resulting signal group to the respective motor 46. This returns the tips of the needles 31A and 31B to a position apart by a predetermined distance from the ink tanks 8B to 8Y.

Here, since introduction of the atmosphere to the second chamber 30B in the state shown in FIG. 3B is performed through the communicating passage 30T, when the needles 31A and 31B are returned to the initial positions, the tank part is in the same state at the time when the tank part alone is in the gas-liquid replacement state and liquid consumption from the head is stopped. As a result, a predetermined amount of each ink is supplied to the ink tanks 8B to 8Y and the inside pressure of the ink tanks 8B to 8Y is set to a predetermined negative pressure. Therefore, after completion of the replenishing operation, in the tank part, the gas-liquid replacement state can be maintained from the time when ink is ejected from the recording head to make recording to the time of entering replenishing operation on the basis of detection output signal group from the above-described remaining amount detection means.

As described above, according to the construction of the present invention, since pressure balance between the first chamber 30A provided with the ink holding body and the second chamber 30B replenished with ink is not required to be adjusted after replenishing operation, almost stable negative pressure can be generated from immediately after the above series of liquid replenishing operation.

Therefore, since there is no fear of ink leakage from the first chamber 30A in association with excessive ink movement from the second chamber 30B to the first chamber 30A as seen in a construction requiring adjustment of pressure balance, and associated suction recovery and the like are not required, ink can be used for recording without dissipation of a recording ink. And as compared to liquid replenishing with the aid of potential energy simply, the time of liquid replenishing is shortened by combination the pump and that in replenishing operation and draining operation.

(Second Embodiment)

Figure 4:
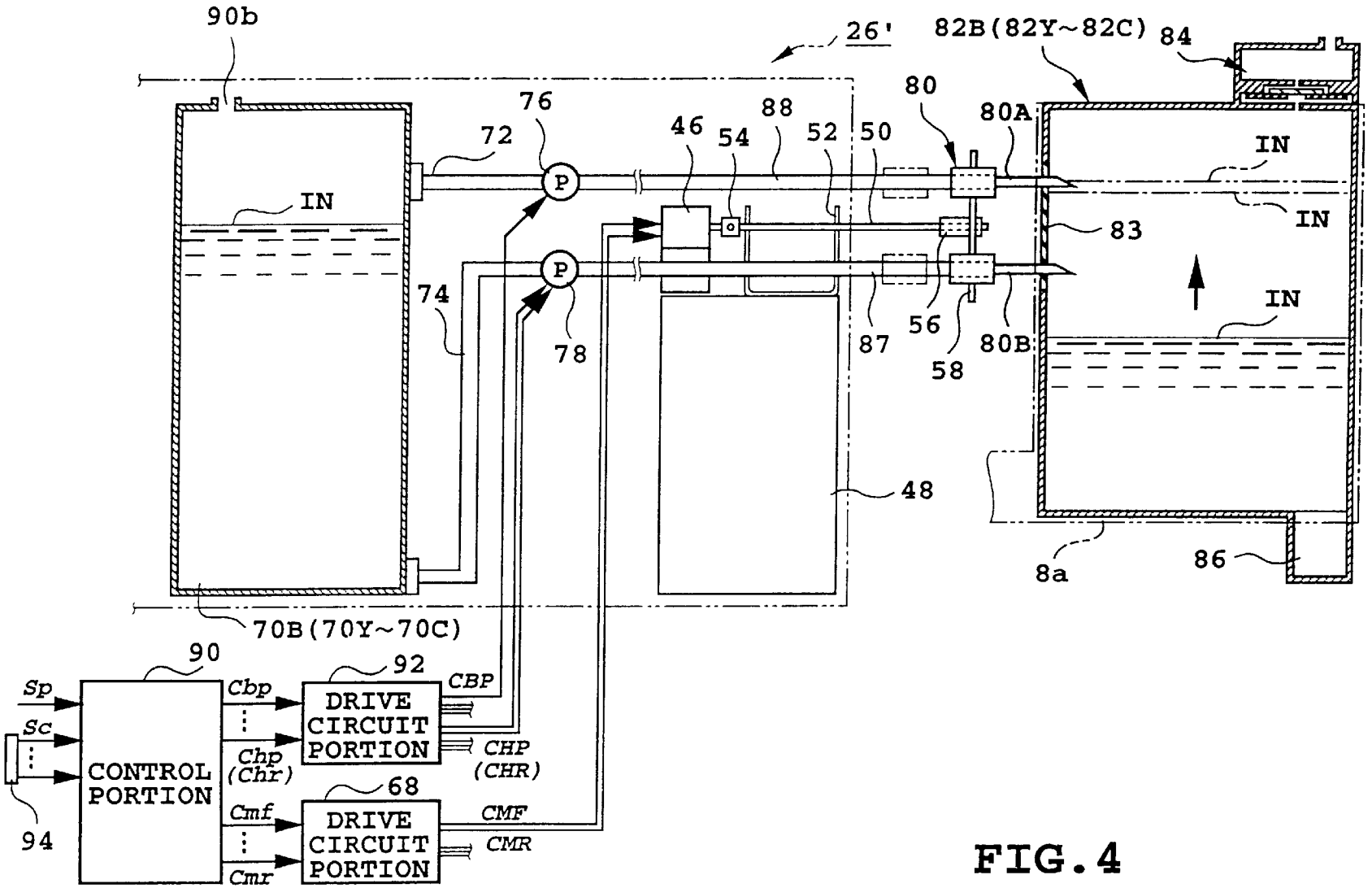
FIG. 4 is a schematic diagram showing the construction of a second embodiment along with the ink tank according to the present invention.
Figure 5:
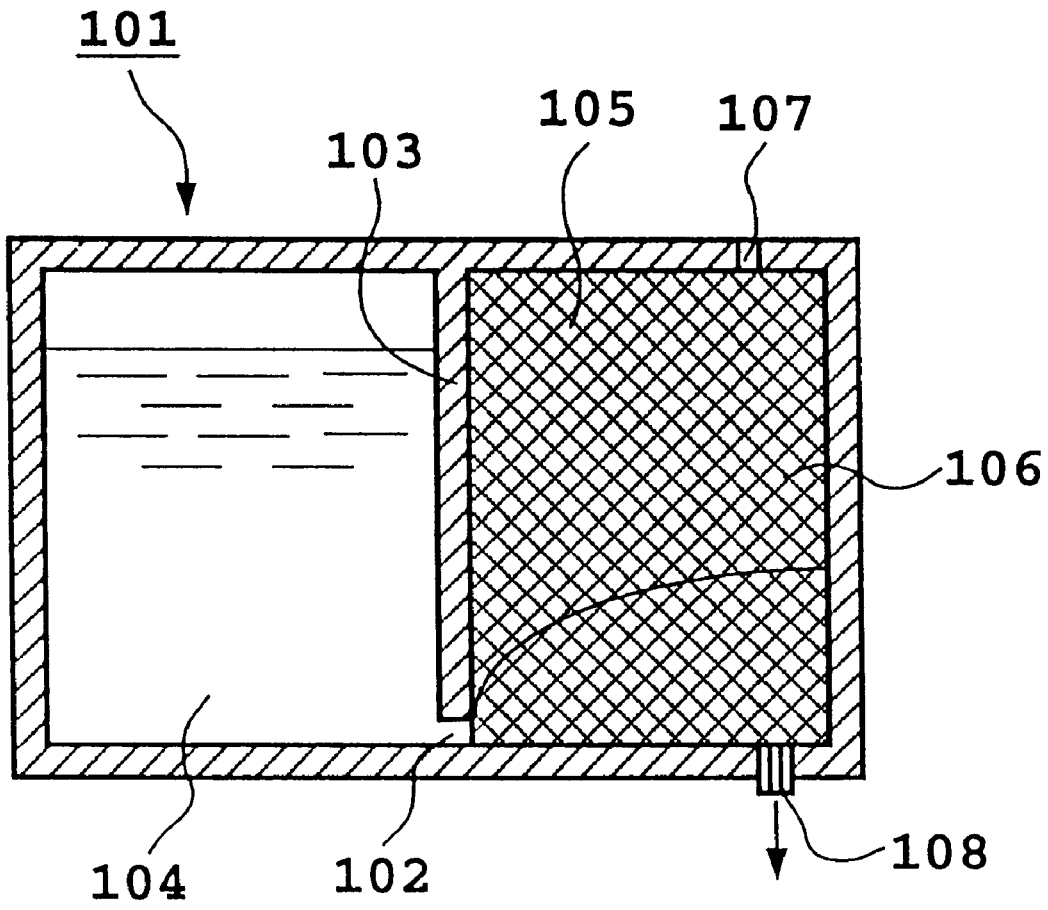
FIG. 5 PRIOR ART
FIG. 5 is a sectional diagram showing an example of a prior art ink tank.

FIG. 4 shows the chief part of a second embodiment of ink injection device according to the present invention. The present embodiment is developed on the basis of the above-described first embodiment.

The entire construction of the ink-jet recording apparatus applied in the example shown in FIG. 4 is almost the same as the construction shown in FIG. 2 and is thus omitted. Further, same components as in the example shown in FIG. 1 are indicated with the same symbols and detailed description thereof is omitted.

In FIG. 4, an ink tank 82B storing black ink, an ink tank 82C storing cyan ink, an ink tank 82M storing magenta ink, and an ink tank 82Y storing yellow ink are arranged same as in the example shown in FIG. 1, and detachably mounted on the carriage member 8*a*, and have the same structure one another.

The ink tank 82B molded from a relatively transparent resin material is provided with an ink-jet head 86 at a part opposing the recording surface of paper 4. Further, the ink tank 82B has not an ink absorber inside as in the above example, and a predetermined amount of black ink is stored in a case 83. Still further, a pressure adjustment portion 84 for adjusting internal pressure in the case 83 is provided in the upper part of the ink tank 82B. The pressure adjustment portion 84 is, for example, as shown in Japanese Patent Application Laid-open No. 256375/1997, one which has a structure in which two thin films closely contacted with silicone oil are provided in the support part, so that internal pressure is not reduced to more than a predetermined negative pressure.

On the wall surface at the back surface side opposing an ink injection device 26' in the ink tank 82B, a septum 84 is provided, which is pierced by tips of needles 80A and 80B. The septum 84 is made of, for example, a rubber material, which, when pierced by the respective tips of the needles 80A and 80B, seals the outer periphery of the needles 80A and 80B. Further, when the tips of the needles 80A and 80B are pulled out, the septum 84 automatically closes the holes formed by the tips of the needles 80A and 80B.

The ink injection device 26', as shown in FIG. 4, comprises ink supply parts 70B to 70Y storing respective color inks supplied according to the respective ink tanks 82B to 82Y, and an injection mechanism portions 80 provided for the respective ink supply parts 70B to 70Y. Since the respective ink supply parts 70B to 70Y and the respective injection mechanism portions 80 are the same in structure, only the ink supply part 70B and the injection mechanism portion 80 provided for the ink tank 82B will be described, and description of ink supply part and injection mechanism portions provided for other ink tanks is omitted.

Inside the ink supply part 70B, a predetermined amount of black ink IN is stored. At the upper part of the ink supply part 70B, an atmosphere communicating port 70*b* for communicating the inside space with the outer atmosphere is provided. An introduction/extraction passage 74 connected to the lower part of the ink supply part 70B is provided with a pump 78 for supplying the ink IN to the ink tank 82B side and returning a predetermined amount of the ink IN stored in the ink tank 82B to the inside of the ink supply part 70B. Further, a return passage 72 connected to the upper part of the ink supply part 70B is provided with a pump 76 for returning the ink IN overflowed from the ink tank 82B to the ink supply part 70B.

The return passage 72 may be provided with a filter for filtering the ink IN. The pumps 76 and 78 are, for example, liquid feed pumps in which the outer peripheral part of a tube is squeezed by revolution of a plurality of rollers around a rotary shaft to feed the ink. The rotary shaft is connected to an output shaft of a motor, by rotating the motor output shaft in the forward direction or reverse direction, the plurality of rollers are rotated and revolved in the forward or reverse direction around the rotary shaft. The motor is driven and controlled according to a control signal from a control portion 90 which will be described later.

The extraction/introduction passage 74 is connected with an end of a tube 87 made of a flexible material. The other end of the tube 87 is connected to a needle 80B having at the tip a hole communicating with the inside of the tube 87. Further, the return passage 72 is connected with an end of a tube 88 made of a flexible material.

The other end of the tube 88 is connected to a needle 80A having at the tip a hole communicating with the tube 88 through its inside. A protruding length of the needle 80B from the support member 58 is set to be equal to the length of the needle 80A.

The needle 80B is connected together with the needle 80A by a support member 58.

The needle 80A and the needle 80B are parallel to each other and supported to be almost perpendicular to the surface of the septum 84 on the wall surface at the back surface side of the ink tank 82B.

In addition, the ink injection device 26' is provided with, as shown in FIG. 4, a control portion 90 for performing operation control of the pumps 76 and 78 and the motor 46.

The control portion 90 is supplied with a detection signal Sp representing that the carriage member 8*a* mounting the ink tanks 82B to 82Y reaches a predetermined home position, and a warning signal group SC from a warning operation portion 94 operated to warn that ink remaining amount of the respective ink tanks 82B to 82Y is less than a predetermined value.

The control portion 90 first forms a control signal group Cmf to pierce the tips of the needles 80A and 80B of the injection mechanism portion 80 to the septum 84 corresponding to the respective ink tanks 82B to 82Y requiring ink supply on the basis of the detection signal Sp and warning signal group SC, and supplied these signals to the drive circuit portion 68.

The drive circuit portion 68 forms a drive control pulse signal group CMF on the basis of the control signal group Cmf, and supplies the resulting signal group to the motor 46. This moves each support member 58 towards each of ink tanks 8B to 8Y forward by a predetermined distance, so that the tips of the needles 80A and 80B, as shown in FIG. 4, penetrate the septum 84 to reach the inside.

Next, the control portion 90 forms a control signal group Chp for replenishing a predetermined amount of each ink to each of ink tanks 82B to 82Y, and supplies these signals to a drive circuit portion 92. The drive circuit portion 92 forms a drive pulse control signal group CHP on the basis of the control signal group Chp, and supplies these signals to the pump 78.

This supplies a predetermined amount of the ink IN through the tube 87 and the needle 80B to the inside of each of the ink tanks 82B to 82Y, to rise the liquid surface, for example, from the position indicated by the solid line to the position indicated by the chain double-dashed line. In this case, the control portion 90 forms a control signal group Cbp to make the pump 76 operative to return a predetermined amount of air and ink to the ink supply parts 70B to 70C side, and supplies these signals to the drive circuit portion 92. On the basis of the control signal group Cbp, the drive circuit portion 92 supplies a drive control pulse signal CBP to the pump 76.

Therefore, inside the respective ink tanks 82B to 82Y, air in the space above the ink IN and the ink reached the hole of the needle 80A are discharged through the hole of the needle 80A. That is, there is no fear that the liquid surface of the ink is risen to over the position set by the needle 80A and the ink leaks to the outside.

Next, the control portion 90 forms a control signal group Chr so as to return a predetermined amount of each ink from the respective ink tanks 82B to 82Y to the respective ink supply parts 70B to 70Y so that the inside pressure of the ink tanks 82B to 82Y is set to a predetermined negative pressure, and supplies these signals to the drive circuit portion 92. The drive circuit portion 92 forms a drive pulse control signal group CHR on the basis of the control signal group Chr, and supplies the resulting signal group to the pump 78.

This returns a predetermined amount of the ink IN to the ink supply part 70B through the tube 87 so that liquid surface of the ink IN of the ink tank 82B is moved down, for example, from the position indicated by the chain double-dashed line shown in FIG. 4 to the position indicated by the chain single-dashed line. In this case, the pump 78 is stopped.

Next, the control portion 90 forms a control signal group Cmr so as to retreat the tips of the needles 80A and 80B from the positions indicated by the solid lines in FIG. 4 to the positions indicated by the chain double-dashed lines, and supplies these signals to the drive circuit portion 68. The drive circuit portion 68 forms a drive control pulse signal group CMR on the basis of the control signal group Cmr, and supplies the resulting signal group to the motor 46. Accordingly, the tips of the needles 80A and 80B from the septum 84 is pulled out. Then, the tips of the needles 80A and 80B are returned to a position apart by a predetermined distance from the ink tanks 82B to 82Y.

Therefore, even when an ink remaining amount detection device is not provided, each ink is supplied to the ink tanks 82B to 82Y and the internal pressure of the ink tanks 82B to 82Y is set to a predetermined negative pressure, without generation of undesirable leakage of ink to the outside.

Although the above description has been made for the ink-jet recording apparatus, however, the ink injection method and the ink injection device according to the present invention can also be applied to other recording apparatus than the ink-jet recording apparatus which generates a negative pressure to make recording.

The present invention has been described in detail with respect to preferred embodiments, and it will now be apparent from the foregoing to those skilled in the art that changes and modifications may be made without departing from the invention in its broader aspect, and it is the invention, therefore, in the apparent claims to cover all such changes and modifications as fall within the true spirit of the invention.

What is claimed is:

1. An ink injection method for replenishing an ink, using a replenishing vessel, to an ink tank having a first chamber containing a negative pressure generating member and provided with an ink supply port for supplying the ink to outside of the ink tank, and an atmosphere communicating port for communicating with outside air, and a second chamber communicating with said first chamber through a communicating portion and forming a substantially enclosed space except for said communicating portion, comprising the steps of:

connecting said second chamber and said replenishing vessel by a first passage for communicating a gas in said second chamber with a gas in said replenishing vessel to said second chamber, and by a second passage which is different from said first passage, the connection forming a substantially enclosed space relative to an atmosphere except for said communicating portion between said second chamber and said replenishing vessel;

after said connecting step, an ink injecting step for moving the ink in said replenishing vessel to said second chamber through said second passage, and moving the gas in said second chamber to said replenishing vessel through said first passage; and after said ink injecting step, a gas introducing step for discharging the ink from said second chamber to said replenishing vessel, and introducing atmospheric air through said communicating portion and through said atmosphere communicating port of said first chamber into said second chamber.

2. The ink injection method as claimed in claim 1, wherein in said gas introducing step, said first passage is in a non-conductive state to said second chamber.

3. The ink injection method as claimed in claim 1, further comprising detecting an ink amount in said second chamber by an ink remaining amount detection means, wherein, said connecting step is performed after detecting that an ink amount in said second chamber is less than a predetermined amount.

4. The ink injection method as claimed in claim 1, wherein ink movement in said ink injecting step and said gas introducing step are performed using a pump.

5. An ink injection device, comprising:

an ink tank for holding ink; and a replenishing vessel for holding ink to be supplied to said ink tank to replenish ink from the replenishing vessel to the ink tank, said ink tank containing a negative pressure generating member and comprising a first chamber provided with a supply port for supplying the ink to outside of the ink tank and an atmosphere communicating port, and a second chamber forming a substantially enclosed space except for a communicating portion communicating with the first chamber, wherein, said second chamber and said replenishing vessel communicate with each other by a first passage for communicating a gas in said second chamber with a gas in said replenishing vessel, and by a second passage which is different from said first passage, for moving ink in said replenishing vessel to said second chamber, and wherein, said second passage is provided with a pump that promotes an ink movement both from said replenishing vessel to said second chamber and from said second chamber to said replenishing vessel.

6. The ink injection device as claimed in claim 5, wherein, said second passage is at a position closer to a connection portion with said ink tank than said first passage.

7. An ink injection device as claimed in claim 5, wherein, said second passage is disposed at a lower side in a gravitational direction than said first passage.

8. An ink injection device as claimed in claim 5, further comprising an ink remaining amount detection means for detecting an ink amount in said second chamber, and control means for controlling conduction of said first and second passages according to a detected result of said detection means.

9. An ink-jet recording apparatus, comprising:

an ink tank for holding an ink;

a recording head for ejecting an ink supplied from said ink tank to perform recording on a recording medium; and a replenishing vessel for holding ink for replenishing said ink tank, said ink tank containing a negative pressure generating member and comprising a first chamber having a supply port for supplying ink to said recording head and an atmosphere communicating port, and a second chamber having a communicating portion for communicating with said first chamber and forming a substantially enclosed space except for said communicating portion, wherein said second chamber and said replenishing vessel communicate with each other by a first passage for communicating a gas in said second chamber with a gas in said replenishing vessel, and by a second passage which is different from said first passage, for moving the ink in said replenishing vessel to said second chamber, and wherein, said second passage is provided with a pump that promotes ink movement both from said replenishing vessel to said second chamber and from said second chamber to said replenishing vessel.

10. The ink-jet recording apparatus as claimed in claim 9, further comprising:

a carriage mounting said ink tank;

a scanning portion for performing relative movement of said carriage along a recording surface of said recording medium; and a transportation means for transporting said recording medium.

11. An ink-jet recording apparatus having an ink tank for holding an ink, a recording head for discharging ink supplied from said ink tank to perform recording on a recording medium, and an ink replenishing vessel for holding ink for replenishing said ink tank, comprising:

a first passage connectable to said ink tank for communicating said ink tank with said replenishing vessel;

a second passage provided with ink moving means connectable to said ink tank for communicating said ink tank and said replenishing vessel with each other and that performs ink movement from said ink tank to said replenishing vessel and from said replenishing vessel to said ink tank, wherein a connection portion of said ink tank for said second passage is provided beneath a connection portion of said in tank for said first passage; and control means for controlling connection of said first and said second passages to said ink tank and operation of said ink moving means, wherein said control means controls an ink injection process in which at least said first and second passages and said ink tank are connected for injection of ink from said second passage to said ink tank and, according to said ink injection, an air in said ink tank is discharged through said first passage, and a discharging process in which said first passage is in a disconnected state, for discharging ink injected through said second passage by said ink moving means from said ink tank so that a negative pressure in said ink tank is at predetermined value.

12. The ink-jet recording apparatus as claimed in claim 11, further comprising an ink recirculating process for injecting ink through said second passage to said ink tank after said ink injecting step and discharging the ink in said ink tank through said first passage according to said ink injection, whereby an ink amount in said ink tank is maintained at a predetermined amount.

* * * * *

UNITED STATES PATENT AND TRADEMARK OFFICE

CERTIFICATE OF CORRECTION

PATENT NO. : 6,234,615 B1
DATED : May 22, 2001
INVENTOR(S) : Tsukuda

It is certified that error appears in the above-identified patent and that said Letters Patent is hereby corrected as shown below:

Column 1,
Line 42, “Inside” should read -- The interior of --; and
Line 45, “enclose” should read -- enclosed --.

Column 2,
Line 25, “pit-in. - system.” should read -- pit-in system. --; and
Line 62, “A concrete objects” should read -- Concrete objects --.

Column 3,
Lines 5, 12, 32 and 54, “enclose” should read -- enclosed --.

Column 4,
Line 46, “be” should read -- can be --.

Column 5,
Lines 34, 35 and 38, “10 m” should read -- 10 --; and
Line 48, “port” should read -- ports --.

Column 6,
Line 22, “septum” should read -- septums --;
Line 26, “is” should read -- are --;
Line 27, “septum” should read -- septums --; and
Line 65, begin a new paragraph at “A”.

Column 8,
Line 41, “discharge.),” should read -- discharge), --.

Column 9,
Line 44, “operation.” should read -- operations. --; and
Line 53, “the” should read -- of the --.

Column 10,
Line 3, “one” should read -- as one --;
Lines 30 and 33, “portions” should read -- portion --.

Column 11,
Line 45, “rise” should read -- raise --;
Line 56, “reached” should read -- that has reached --; and
Line 59, “is risen to over” should read -- rises higher than --.

UNITED STATES PATENT AND TRADEMARK OFFICE

CERTIFICATE OF CORRECTION

PATENT NO. : 6,234,615 B1
DATED : May 22, 2001
INVENTOR(S) : Tsukuda

It is certified that error appears in the above-identified patent and that said Letters Patent is hereby corrected as shown below:

Column 12,
Line 18, “is” should read -- are --.

Column 14,
Line 39, “in” should read -- ink --; and
Line 54, “at” should read -- at a --.

Signed and Sealed this

Thirteenth Day of August, 2002

*Attest:*

*Attesting Officer*

JAMES E. ROGAN
*Director of the United States Patent and Trademark Office*